US005165314A

United States Patent [19]

Paulson et al.

[11] Patent Number: 5,165,314

[45] Date of Patent: Nov. 24, 1992

[54] SLITTING SHINGLED SHEETS

[75] Inventors: Richard F. Paulson; James A. Cummings, both of Phillips, Wis.

[73] Assignee: Marquip, Inc., Phillips, Wis.

[21] Appl. No.: 763,333

[22] Filed: Sep. 20, 1991

Related U.S. Application Data

[63] Continuation-in-part of Ser. No. 557,221, Jul. 24, 1990, abandoned.

[51] Int. Cl.[5] ..... B26D 1/15

[52] U.S. Cl. ..... 83/29; 83/174.1; 83/424; 83/435.2; 83/449; 83/493; 83/500; 83/594; 493/370

[58] Field of Search ..... 83/594, 174.1, 13, 345, 83/346, 420, 424, 435.2, 447, 449, 500, 505, 493, 29; 493/370, 64

[56] References Cited

U.S. PATENT DOCUMENTS

| | | | |
|---|---|---|---|
| 239,235 | 3/1881 | Flohr | 83/594 |
| 1,210,454 | 1/1917 | Gagne | 83/493 |
| 1,806,458 | 5/1931 | Hayden | 83/594 |
| 3,386,323 | 6/1968 | Dovey | 83/505 X |
| 3,820,289 | 6/1974 | Good | 83/174.1 X |
| 4,669,347 | 6/1977 | Worner | 83/500 X |

FOREIGN PATENT DOCUMENTS

| | | | |
|---|---|---|---|
| 0017878 | 10/1980 | European Pat. Off. | 83/500 |

*Primary Examiner*—Douglas D. Watts
*Assistant Examiner*—Kenneth E. Peterson
*Attorney, Agent, or Firm*—Andrus, Sceales, Starke & Sawall

[57] ABSTRACT

A method and apparatus for longitudinally slitting a continuously moving shingle of sheets of corrugated paperboard includes a thin, circular rotary slitting blade cooperating with a lower roller assembly which supports the underside of the moving shingle and provides a firm surface to support the shingle against the upper rotating slitting blade. The roller assembly includes an annular circumferential slot in its outer surface through which an edge portion of the upper cutting blade travels with the shingle firmly supported by the roller surfaces on each side of the slot. In an embodiment of the invention for slitting a shingle of preformed knocked down boxes, the lateral edges of the advancing shingle are aligned and the shingle is held for movement into the slitting blade, resulting in extremely good registration and slit quality.

6 Claims, 6 Drawing Sheets

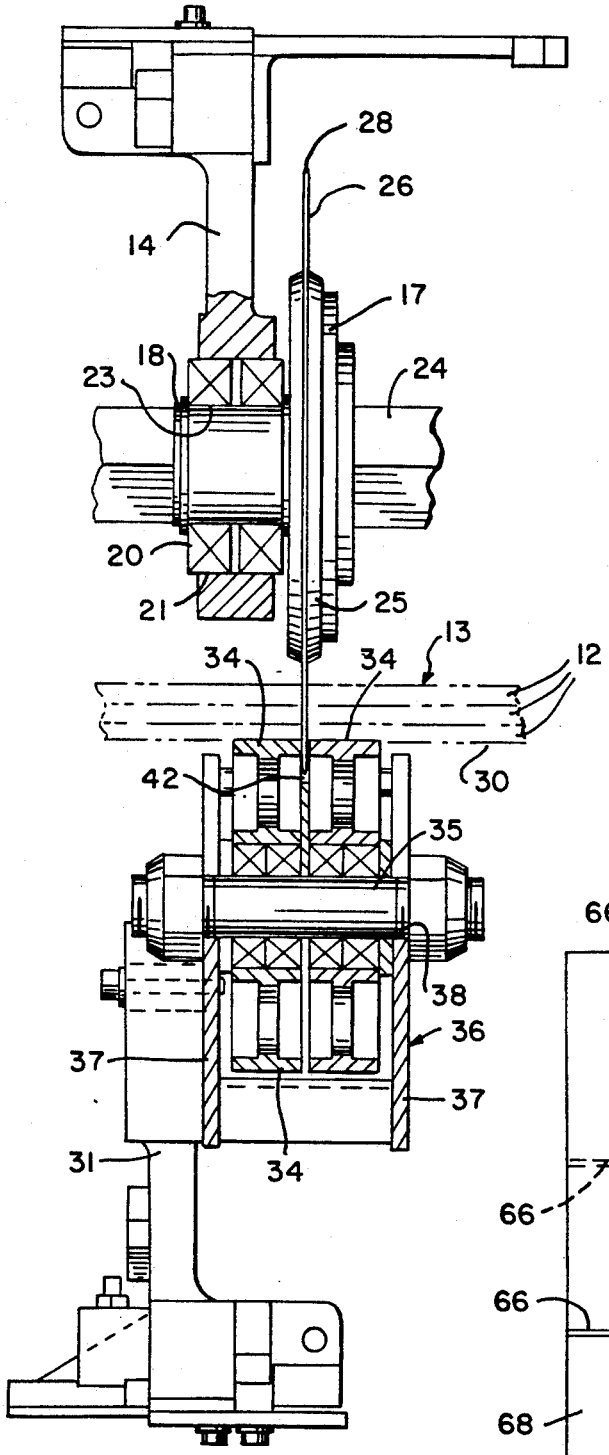
FIG. 4
FIG. 6
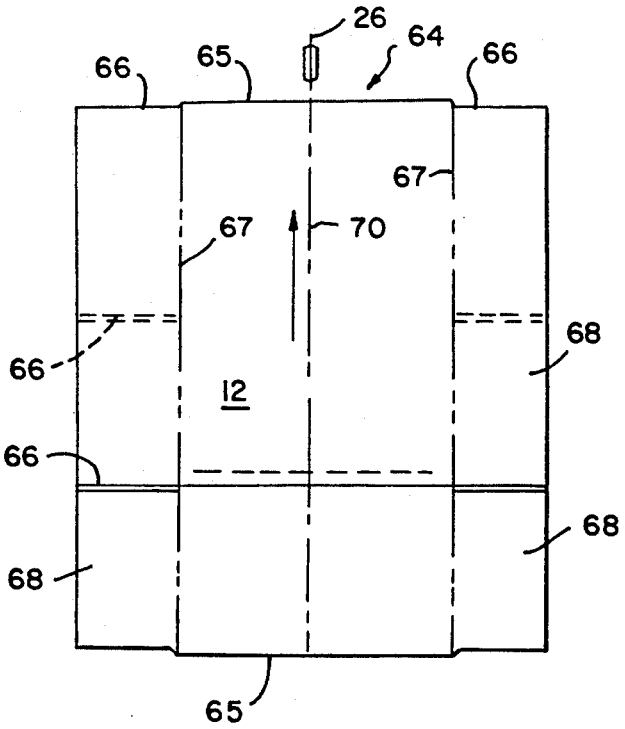

SLITTING SHINGLED SHEETS

This is a continuation-in-part of application Ser. No. 07/557,221, filed Jul. 24, 1990, now abandoned.

BACKGROUND OF THE INVENTION

The present invention relates to an apparatus and related method for simultaneously slitting multiple layers of corrugated paperboard or the like and, more particularly, to techniques utilizing a thin rotary slitting blade for longitudinally slitting an advancing shingle of multiple overlapping sheets of corrugated paperboard.

Apparatus for longitudinally slitting a continuous traveling sheet or web of corrugated paperboard is well known in the art. Typically, multiple slitting tools are mounted coaxially and are laterally spaced across the width of the sheet in selectively adjustable positions. Similarly, multiple scoring tools may also be coaxially mounted and spaced across the sheet width such that the traveling sheet may be scored and slit simultaneously.

In conventional prior art apparatus, each pair of upper and lower slitting tools is disposed with overlapping radial cutting edges between which the advancing paperboard sheet is moved to provide a continuous cut. Although the operation is commonly referred to as "slitting", the cutting tools in fact shear the moving sheet causing a relative vertical displacement of the cut edges from one another. As the thickness of the corrugated board increases, the cuts tend to become more ragged, the edges tend to be crushed, and the quality of the cut degrades significantly. Another problem commonly associated with rotary shear cutting of corrugated board is the generation of dust. Fine paper dust is a very serious problem which may result in clogged filters on air handling systems, hazardous air quality for workers, contamination of electronic and other equipment, and even explosion or fire hazards. Conventional shear-type slitting often simply cannot provide adequate slit edge quality for heavy board thicknesses or for multiple layers of board. As a result, attempts to utilize conventional shear-type slitting for heavy double and triple wall corrugated board fail because the edge quality is poor in appearance or is structurally unacceptable.

U.S. Pat. No. 4,627,214 shows a slitter-scorer apparatus of one prior art construction in which the board is sheared by passage between the overlapping edges of a pair of rotary cutting knives. Even when such cutting knives are properly adjusted and maintained in a sharpened condition, their use to slit heavier double and triple wall board has been less than satisfactory. Attempts to utilize this apparatus to cut multiple layers simultaneously would, similarly, result in unsatisfactory slit quality.

As a result of the limitations inherent in conventional shear-type slitting, the use of slitters has been relegated primarily to the slitting of a continuous sheet as it exists the corrugator. However, slitting could be employed at other stages in the manufacture of a corrugated paperboard box, if the problems with slit quality degradation with increasing board thickness and multiple layers could be remedied. For example, in certain applications it is desirable to longitudinally slit a partially assembled box or carton as it exits in a double layer configuration from a flexo-folder-gluer. However, attempts to utilize conventional slitting technology on such a double layer configuration has been less than satisfactory. Furthermore, conventional processing strategy utilizes shingling of serially processed sheets (such as partially assembled containers from the flexo-folder gluer) in order to reduce conveyor lengths and to facilitate stacking. If downstream slitting of shingled sheets is desired, however, the sheets must first be unshingled, slit singly, and then reshingled for further processing. This not only requires additional processing equipment, but also reduces processing speed. Furthermore, shear-type slitting of an assembled double layer container results in generally poor quality edges. For example, in the manufacture of two half slotted containers (HSC's) from a single regular slotted container (RSC) by slitting the latter longitudinally, it is customary to provide extra edge material to compensate for the collapse of the edge under stacking loads, the collapse being the result of slit edge degradation caused by shear-type slitting.

Another problem which has been encountered in the prior art and remains unsolved is maintaining registration of knocked down boxes, such as RSCs, so that the longitudinal dividing slit is always accurately located to maintain the transverse dimensions of the two resulting containers as precise as possible. Similarly, a persistent problem in the prior art is to retain the squareness of knocked down boxes which are printed, folded and glued in a flexo-folder-gluer, but which often become out-of-square as a result of downstream handling before the glue is set.

U.S. Pat. No. 3,599,518 discloses a device for longitudinally slitting a continuous sheet of corrugated paperboard which is intended to overcome the deficiencies inherent in conventional shear-type slitting, discussed above. In the device disclosed in this patent, a rotatable annular slitting blade slits the advancing sheet which is supported from below on a bristled brush roller into which the cutting edge of the blade penetrates as it passes through the paperboard sheet. The blade is rotated at a high overspeed with respect to the speed of the advancing paperboard sheet and the supporting brush roller is rotated at a slight overspeed with respect to the advancing sheet. The peripheral cutting edge of the blade is serrated and hard faced to retain sharpness. This patent also discloses the use of nozzles to discharge a mist of steam or oil downwardly onto the cutting blade from above to prevent the accumulation and drying of adhesive and paper dust on the blade or blades.

However, the use of a supporting brush roll has been found to have the following drawbacks. If the bristles are made stiff enough to provide adequate support for the paperboard sheet, the blade tends to cut the bristles. If the bristles are made more flexible to avoid cutting, adequate support for the sheet is lost. In addition, a serrated blade creates substantially more board dust and, in addition, serrated blades are difficult to sharpen and in any event must be removed from the machine for sharpening. Furthermore, spraying of any liquid onto the blade, particularly oil, inevitably results in unacceptable overspray which contaminates the board, the equipment and the atmosphere.

In copending and commonly assigned patent application Ser. No. 490,793, filed Mar. 8, 1990, now abandoned, there is described a slitting apparatus which overcomes many of the problems associated with prior art shear-type slitting. That apparatus, however, is particularly adapted to provide one or more longitudinal slits in a single continuous sheet, such as that exiting a corrugator. The apparatus disclosed in that application does not provide the capability for slitting multiple sheets, particularly a shingle of multiple overlapping sheets of corrugated paperboard.

Therefore, it would be most desirable to provide a method and apparatus for the simultaneous slitting of multiple overlapping layers of corrugated paperboard and, particularly, for the continuous slitting of paper in a shingled configuration. It would be especially desirable to have a method and apparatus which could accurately and cleanly slit shingled knocked down boxes out of a flexo-folder-gluer.

SUMMARY OF THE INVENTION

In accordance with the present invention, a continuous shingle of corrugated paperboard sheets is cut with a true slitting technique in an apparatus in which the advancing shingle of paperboard is conveyed through a sharp, thin circular blade running in the same direction as the paperboard sheet, but at a higher speed, with the shingle supported below the blade by rollers making tangent contact with the underside of the shingle.

In a basic embodiment of the invention, the slitting apparatus includes an annular blade rotatably mounted above the shingle with the peripheral cutting edge of the blade extending beyond the underside of the shingle. Roller means rotatably mounted below the shingle is provided with a cylindrical outer surface which are positioned to make tangent contact with the lower surface of the shingle. The outer surface of the roller means is provided with an annular circumferential slot which has a width greater than the width of the edge of the cutting blade and is positioned to receive the blade edge therein to form a nip. Means are also provided for holding the relative positions of the sheets which comprise the shingle and for moving the shingle into the nip. Means are provided to rotate the blade in the direction of movement of the advancing shingle and at a speed greater than the speed of the shingle.

The means for holding and moving the shingle includes lower infeed conveyor means positioned to support the shingle from below and to move it into the nip and upper infeed conveyor means adapted to engage the upper surface of the shingle to hold it against the lower infeed conveyor means and to move the shingle concurrently with the lower infeed conveyor means. Means are also provided for driving the upper and lower infeed conveyor means at the same speed and for providing vertically adjustable biasing movement of the upper infeed conveyor means relative to the lower infeed conveyor means and the shingle. The lower and upper infeed conveyor means preferably comprises a pair of parallel vertically spaced lower and upper belt conveyors.

Means are also provided for vertically aligning the lateral edges of the sheets in the shingle and that vertical aligning means most preferably comprises a pair of lateral side guides each having a vertical alignment surface parallel to the direction of shingle movement and spaced laterally at a distance approximately equal to the width of the shingle. At least one of the side guides is preferably laterally adjustable to accommodate varying shingle widths.

To prevent the buildup of paperboard glue on the cutting blade, means are provided for lubricating the peripheral edge of the blade, as disclosed in the copending application identified above. As also disclosed therein, on-the-fly blade sharpening may also be used.

The roller means which provides tangent support to the underside of the shingle and creates the cutting nip with the blade comprises a pair of coaxially mounted rollers which are axially spaced to define the annular blade-receiving slot.

In one embodiment, the apparatus includes means for conveying the slit shingle from the nip. The conveying means includes an outfeed conveyor means supporting the shingle from below for conveying it away from the nip. Holddown means are mounted above and positioned to hold the shingle against the lower outfeed conveyor means. In the preferred embodiment, the lower outfeed conveyor means comprises a lower outfeed belt conveyor and the holddown means comprises an upper outfeed belt conveyor. Means are provided for driving the upper and lower outfeed belt conveyors at the same speed as the upper and lower infeed belt conveyors. In an alternate embodiment, the holddown means comprises a holddown roller for each portion of the slit shingle exiting the nip. Means are also provided for vertically biasing the holddown rollers against the upper surface of the slit shingle portions.

The related method of longitudinally slitting an advancing shingle of corrugated paperboard or the like includes the steps of positioning the axis of a rotatable annular cutting blade above the advancing shingle such that the peripheral edge of the blade extends beyond the lower surface of the shingle, supporting the shingle adjacent the peripheral edge of the blade with a cylindrical roller making tangent contact with the underside of the shingle, providing the roller with an annular circumferential slot positioned to receive therein the peripheral edge of the blade, and holding the shingle to maintain the relative positions of the sheets and simultaneously moving the shingle through the nip between the blade and the roller.

In a presently preferred embodiment of the apparatus and method of the present invention, an advancing shingle of slotted containers (also referred to as knocked down boxes) formed upstream in a flexo-folder-gluer is slit into two identical halves to form a pair of shingles of half-sized slotted containers. In accordance with the preferred method, a shingle of knocked down boxes is formed and transported on a conveyor with the folded edges of the boxes extending transversely of the conveyor. The boxes forming the shingle are shifted transversely on the conveyor to align the lateral edges of the shingle and the shingle is also held vertically by applying a vertical force to the upper surface of the shingle of a magnitude small enough to allow the boxes to be shifted transversely for edge alignment. The advancing shingle is directed into a rotatable annular cutting blade which has a smooth continuous peripheral cutting edge and is rotated in the direction of shingle movement to provide a peripheral blade edge speed at least about two times greater than the speed of the advancing shingle. As in the previously described embodiments, the shingle is supported below the cutting blade on an idler roller having an annular circumferential slot positioned to receive the peripheral edge of the blade therein to form a nip.

Preferably, the peripheral cutting edge of the annular blade is defined by similar beveled edge faces on opposite sides, each of which faces is sharpened on-the-fly by a rotary grinding wheel making intermittent contact. A double wheeled sharpening device may be used to simultaneously sharpen both faces on-the-fly.

The apparatus and method of the present invention are particularly well adapted to provide optimized registration or accurate lateral edge alignment of the shingle. Further, by aligning the boxes forming the shingle before the glued edges are set, the apparatus for providing lateral alignment of the edges will also square the boxes.

BRIEF DESCRIPTION OF THE DRAWINGS

FIG. 4 is an end elevation of the apparatus shown in FIG. 3.

FIG. 6 is a plan view of a single regular slotted container of one type which may be shingled for slitting in accordance with the present invention.

DETAILED DESCRIPTION OF THE PREFERRED EMBODIMENT

Figure 1:
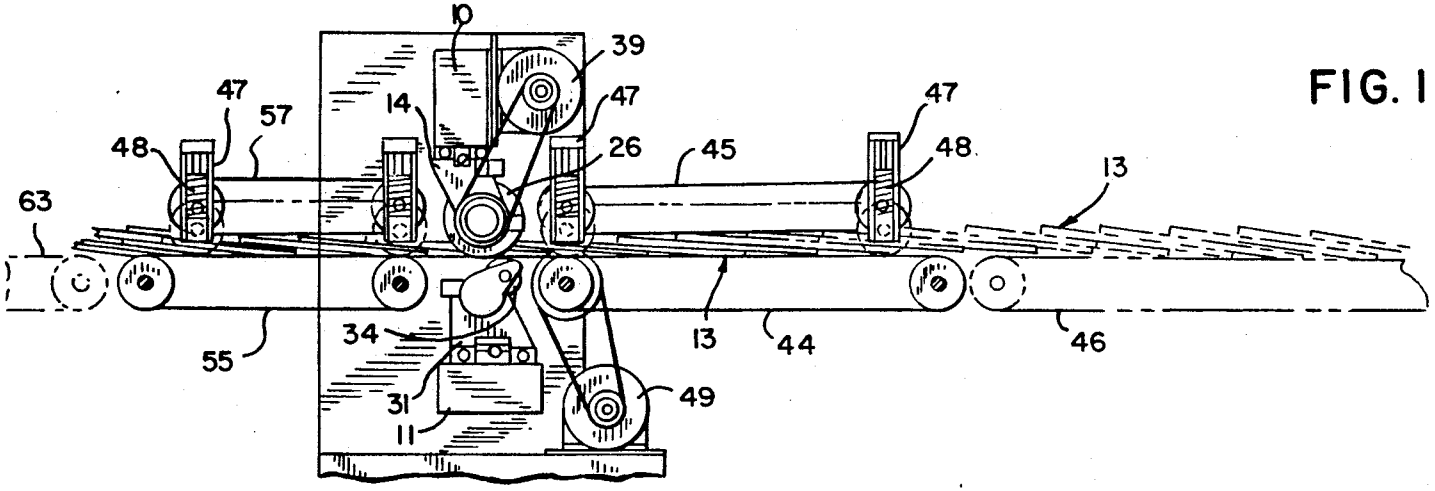
FIG. 1 is a side elevation, partly in section, of the shingle slitting apparatus of the present invention.

The main supporting framework for the shingle slitting apparatus of the present invention includes a horizontal upper beam 10 and a parallel lower beam 11. The beams 10 and 11 extend across the width of the slitting apparatus and are somewhat longer than the maximum width of the sheets 12 which are partially stacked in overlapping relation to form a shingle 13. Various methods and apparatus for shingling sheets are well known in the art and form no part of the present invention. The shingle 13 is generally produced in a continuous length and is moved between the upper and lower beams 10 and 11 and the attached components of the shingle slitting apparatus to be hereinafter described.

One or more upper tool heads 14 are attached to the underside of the upper beam 10 for individual movement across the width of the shingle 13 on a pair of linear ways 15 attached to the beam 10. Each upper tool head 14 has a pair of linear bearing pads 16 attached to its upper edge, which bearing pads connect the tool head 14 to the linear ways 15 for positioning movement to set the tool head in the position where a longitudinal slit through the shingle 13 of sheets 12 is desired. Each upper tool head 14 includes a rotary tool holder 17 which, in turn, includes an inner hub 18 forming the inner race of a rotary bearing 20. The outer race 21 of the rotary bearing 20 is secured to an annular box 22 in the tool head 14. The inner hub 18 of the tool holder 17 has an axial through bore 23 having a non-circular cross section, such as the hexagonal shape shown. The through bores 23 of each of the tool holders 17 mounted on the upper tool heads 14 lie on a common axis. A drive shaft 4 having a hexagonal cross section is mounted to extend through the axial through bores 23 in each of the coaxially mounted tool holders 17. The drive shaft 24 extends across the full width of the apparatus and is connected at one end to a suitable drive means, whereby driving rotation of the shaft causes the tool holders 17 to rotate in bearings 20 with respect to the tool heads 14. Also, the drive shaft 24 provides support for all commonly mounted tool holders 17 and tool heads 14 for movement along the linear ways 15. Each tool holder 17 includes an outer hub 25 to which a thin annular slitting blade 26 is demountable attached, as with a series of machine screws 27 disposed in a circular pattern. The blade 26 has a radial width extending outwardly from the hub 25 somewhat greater than the total vertical thickness of the shingle 13 to be slit. Further, the blade 26 depends downwardly from its tool head 14 such that its peripheral cutting edge 28 extends below the underside 30 of the shingle 13 of the corrugated paperboard sheets 12.

One or more lower tool heads 31 are support for individual sliding movement along a pair of lower linear ways 32 which are, in turn, attached to the upper surface of the lower beam 11. Each lower tool head 31 is supported for movement along the linear ways 32 by a pair of bearing pads 33 similar to the bearing pads 16 on the upper tool heads 14. A pair of identical cylindrical rollers 34 are coaxially mounted on each lower tool head 31 for rotation on an axis parallel to the axis of the upper drive shaft 24. The rollers 34 are mounted with suitable bearings on a roller shaft 35 which is, in turn, supported in a roller mounting bracket 36. The roller mounting bracket 36 comprises a pair of vertical side plates 37 interconnected at their lower edges. Each of the side plates 36 includes an upwardly opening mounting slot 38 for receipt of the roller shaft 35. The roller mounting bracket 36 is adjustably attached to one face of the lower tool head 31 by a pair of locking screws 41. Vertical adjustment of the rollers 34 is provided with a pair of diametrically opposite adjustment slots 40 in the side plate 37 adjacent the roller mounting bracket 36. In this manner, the vertical position of the rollers 34 may be varied at the time of machine set up to obtain accurate vertical positioning of the rollers with respect to the slitting blade 26. The roller mounting bracket 36 is locked in position with the locking screws 41 extending through the adjustment slots 40 and into suitably tapped holes in the lower tool head 31.

The rollers 34 are maintained axially spaced from one another on the roller shaft 35, as by the use of suitable shims, to define therebetween an annular circumferential slot 42 having a width slightly greater than the thickness of the blade 26. The roller mounting bracket 36 and attached rollers 26 are positioned such that the rollers make tangent contact with the lower surface of the moving shingle 13 and permit a portion of the downwardly depending edge 28 of the blade 26 to be received in the slot 42 between the rollers. The blade 26 is rotated in a clockwise direction as viewed in FIGS. 1 and 3 and the moving shingle 13 is directed over the rollers 34 and into the nip formed between the rollers and the blade in the direction of rotation thereof, i.e. from right to left as viewed in FIGS. 1, 2 and 3. The drive shaft 24 is driven, as with blade drive motor 39, at a speed sufficient to impart an edge speed to the blade 26 which is preferably substantially greater than the linear speed of the sheet. For example, the edge speed of the blade may be as much as three times the speed of the sheet or greater. By utilizing a very thin blade, having a thickness for example of 0.035 inches, and maintaining the peripheral cutting edge 28 thereof in a sharpened condition, the full thickness of a multiple sheet shingle 13 of corrugated paperboard may be completely slit with a virtually dust-free and extremely clean cut.

The roller 34 may be constructed, sized, and positioned with respect to the blade 26 in the same manner described with respect to the preferred embodiment of the apparatus described in the above identified copending and commonly assigned application. However, the blade 26 of the present invention is preferably provided with a radial width from the mounting hub 25 to the peripheral edge 28 substantially greater than the blade described and shown in the copending application. The increased radial width of the blade 26 accommodates the increased thickness of a typical shingle 13 of sheets 12, as compared to the single continuous sheet described with respect to the apparatus in the copending application.

As also disclosed in the previously identified copending application, each of the upper tool heads 14 of this apparatus is provided with a blade lubricator 43 and an on-the-fly sharpening device (now shown). Both the lubricator 43 and the sharpening device may be essentially identical to those shown and described in t hat application which is incorporated in its entirety by reference into this application.

Figure 2:
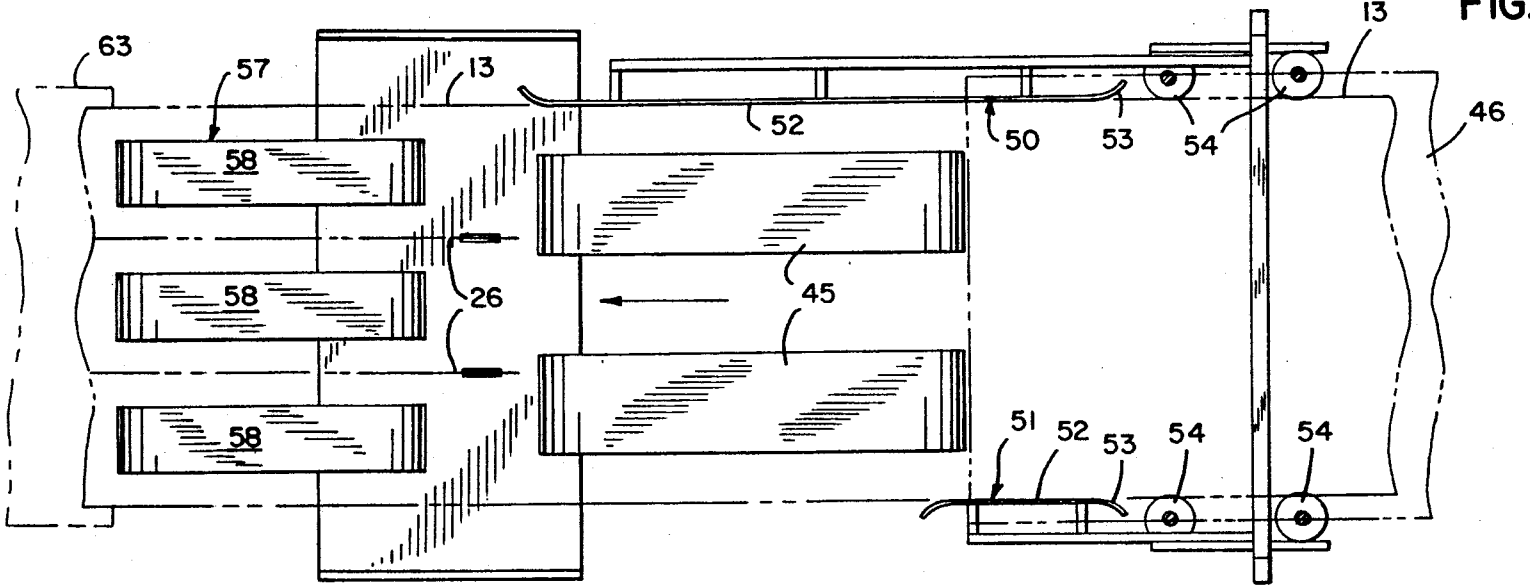
FIG. 2 is a top plan view of the apparatus shown in FIG. 1.
Figure 3:
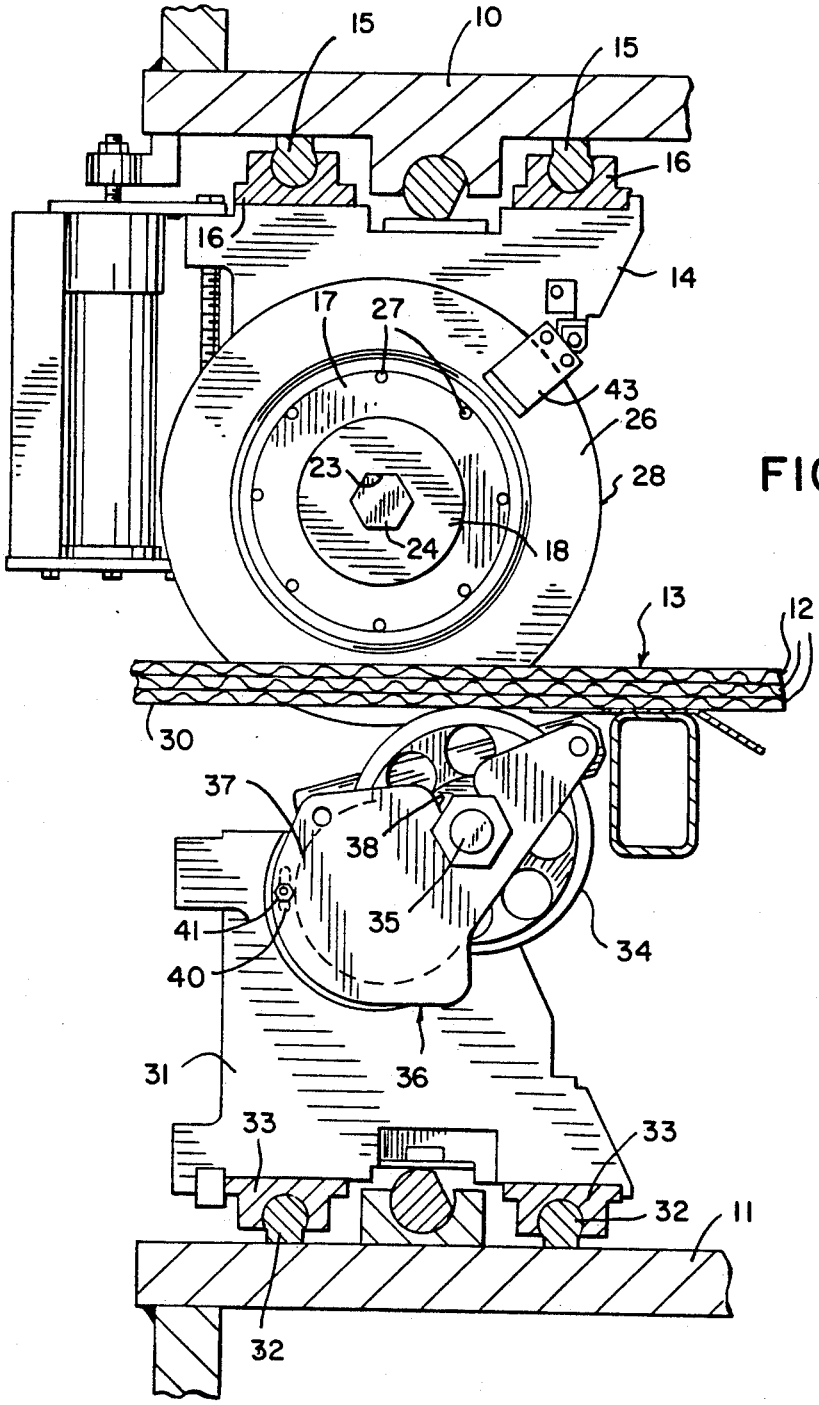
FIG. 3 is an enlarged detail of a portion of the apparatus shown in FIG. 1.

It has been found that, in order to accurately slit a multi-sheet shingle 13, the shingle must be held while it is moved into the nip between the blade 26 and the rollers 34 to maintain the relative positions of the sheets thin the shingle, both longitudinally and laterally. As is best shown in FIGS. 1 and 2, the shingle 13 is directed into the blade 26 for slitting between a pair of lower and upper belt conveyors 44 and 45, respectively. Depending upon the width of the shingle, two identical laterally spaced pairs of lower and upper belt conveyors 44 and 45 may be utilized. The belt conveyors 44 and 45 are vertically spaced to sandwich the shingle 13 therebetween and are mechanically interconnected and driven by belt drive motor 49 to operate at identical linear speeds. In the embodiment shown, the shingle is received by the lower and upper belt conveyors 44 and 45 from a conventional shingle conveyor 46 upstream thereof and operating at the same speed.

The upper belt conveyor 45 is mounted to move vertically with respect to the lower belt conveyor 44 and the shingle 13. In one embodiment, the upper belt conveyor 45 may be supported in a pair of vertical adjustment brackets 47 each of which includes a biasing mechanism, such as a vertically disposed bias spring 48, for urging the upper belt conveyor downwardly to maintain the belt in driving engagement with the upper surface of the shingle 13. In lieu of the spring biasing mechanism, the upper belt conveyor may be pneumatically loaded to allow it to float vertically while maintaining the desired downward force on the shingle being conveyed between it and the lower belt conveyor 44.

As shown in FIGS. 1 and 2, the slitting apparatus of the present invention also preferably includes a pair of laterally spaced side guides 50 and 51 for maintaining vertical alignment of the lateral edges of the sheets 12 in the moving shingle 13. The side guide 50 is preferably fixed and the opposite side guide 51 is laterally adjustable to accommodate varying shingle widths. Each of the side guides 50 and 51 includes a vertical alignment surface 52 parallel to the direction of shingle movement and spaced laterally from one another a distance just slightly greater than the width of the shingle. The side guides 50 and 51 act in conjunction with the lower and upper infeed belt conveyors 44 and 45 to maintain accurate sheet registration within the shingle, resulting in extremely accurate slits which are dimensionally very consistent from one sheet to the next. The side guides 50 and 51 preferably extend upstream beyond the upstream ends of the belt conveyors 44 and 45 and include lead in ramps 53 on the upstream edges of the vertical alignment surfaces 58 to facilitate alignment of the sheets in the incoming shingle. The shingle guidance and alignment system may also include oppositely disposed pairs of guide rollers 54 upstream of the side guides 50 and 51 near the outlet end of the shingle conveyor 46. The guide rollers 54 are positioned to make tangent contact with the lateral edges of the shingle 13 to help align the same for movement into the side guides 50 and 51.

In some applications, it has also been found to be useful to provide means for receiving the slit shingle as it exits the slitting blade or blades 26 and for holding the slit shingle portions as they are conveyed away from the slitting nip. In the embodiment shown in which two slitting blades 26 are utilized to slit the shingle into three portions, the outfeed conveyor means includes a lower outfeed belt conveyor 55 comprising three parallel spaced conveyor sections 56, operated by a common drive at the same speed. Obviously, more or less conveyor sections 56 may be utilized as desired.

The outfeed conveyor means also includes an appropriate holddown mounted above the lower outfeed belt conveyor 55 to hold the slit shingle portions in proper alignment. Preferably, the holddown comprises an upper outfeed belt conveyor 57 which may consist of a separate upper conveyor section 58 for each of the lower conveyor sections 56 comprising the lower outfeed belt conveyor 55. The upper outfeed belt conveyor 57 is mounted on adjustment brackets 47 including vertically oriented bias springs 48, in the same manner as the mounting of the upper infeed belt conveyor, to sandwich the slit portions of the shingle as previously described.

Figure 5:
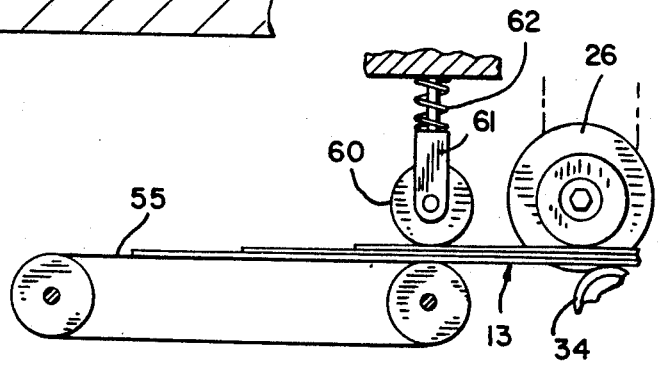
FIG. 5 is a side elevation, similar to FIG. i, showing an alternate embodiment of the apparatus.

In an alternate embodiment shown in FIG. 5, the holddown for the outfeed conveyor means may comprise a series of holddown rollers 60 which are coaxially mounted above the upstream end of the lower outfeed belt conveyor 55. The holddown rollers 60 are mounted to move or float vertically in a manner similar to the upper outfeed belt conveyor 57 of the preferred embodiment. The holddown rollers 60 may comprise conventional idler rolls made with a flexible synthetic material, such as polyurethane. The holddown roller 60 may be mounted in suitable brackets 61 each of which includes bias spring 62 to maintain a downward holding force to keep the rollers in biasing contact with the upper surface of the shingle exiting the slitting station. As the slit shingle portions exit the lower and upper outfeed belt conveyors 55 and 57, they are transferred to a suitable downstream conveyor 63 by which they are directed for further processing, such as stacking or the like.

As indicated previously, the shingle slitting apparatus of the present invention has wide adaptability for use in different stages of a process for the manufacture of corrugated paperboard containers. In addition, use of the process and apparatus of the present invention provides the ability to eliminate intermediate processing steps and the equipment utilized therein. For example, it is known to produce half slotted containers (HSC's) by longitudinally slitting a regular slotted container (RSC) which is assembled prior to slitting in a flexo-folder-gluer. Referring to FIG. 6, there is shown in top plan view a regular slotted container 64 of the type folded and glued in a flexo-folder-gluer. The RSC 64 includes the typical end fold lines 65 marking the transition between the upper and lower layers (only the former being seen in FIG. 6). The usual slots 66 and score lines 67, formed upstream of the flexo, define the end flaps 68 of the completed box. In an RSC, the flaps 68 would comprise the top and bottom walls of the container. However, when two HSC's are formed from an RSC, the flaps of course comprise the bottom wall of each HSC which has an open top. The RSC's are typically shingled as they exit the flexo-folder-gluer and conveyed downstream for separation into two HSC's with a single centered longitudinal slit 70. Because the RSC comprises two layers of board and the board may also comprise a double wall construction, conventional hear-type slitting techniques have provided a less than satisfactory slit even though the blanks are unshingled and slit individually. Thus, although the possibility of doubling the output of HSCs from a flexo-folder-gluer exists, the need to unshingle for slitting, reshingle after slitting, and the resultant poor slit quality all detract substantially from the potential for increased production. By employing the method and apparatus of the present invention, the RSC's from the flexo may be slit in a single continuously advancing shingle. This eliminates completely the need to unshingle for individual slitting and to reshingle after slitting and, moreover, the quality of the slits utilizing the single thin slitting blade of the present apparatus is vastly improved over prior art shear-type slitting tools. The apparatus and method of the present invention; in this specific application, allows a true two-fold increase in production without any degradation in slit quality and without the need for interposing additional processing steps and equipment. Indeed, aligning and holding the shingle as it advances through the slitting stage actually provides better slit registration and accuracy than prior methods using conventional slitting technology to slit one container at a time.

Figure 7:
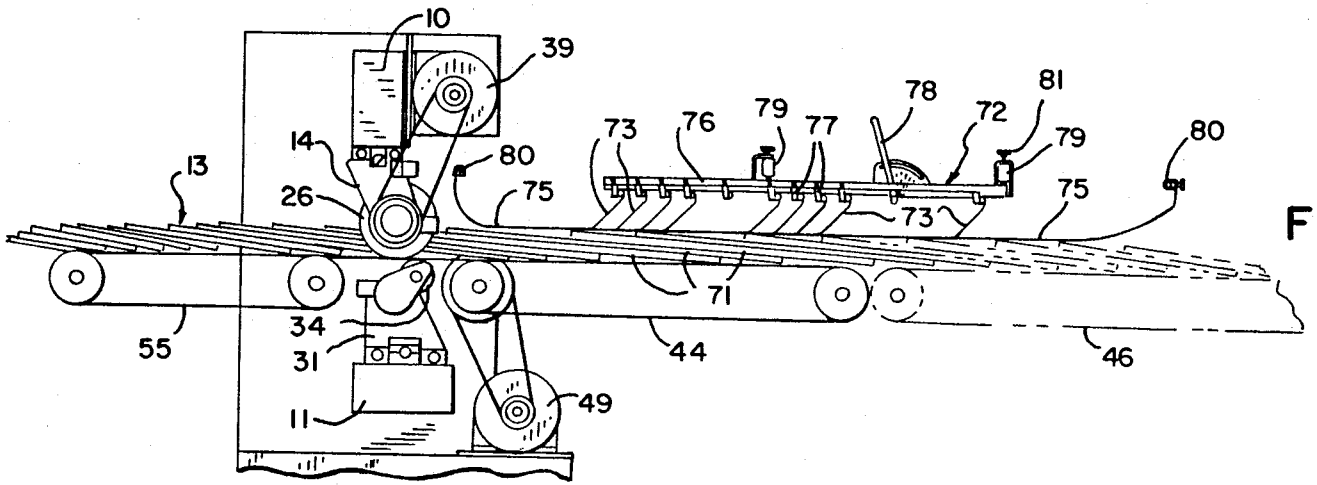
FIG. 7 is a side elevation, similar to FIG. 1, showing the presently preferred embodiment of the apparatus.
Figure 8:
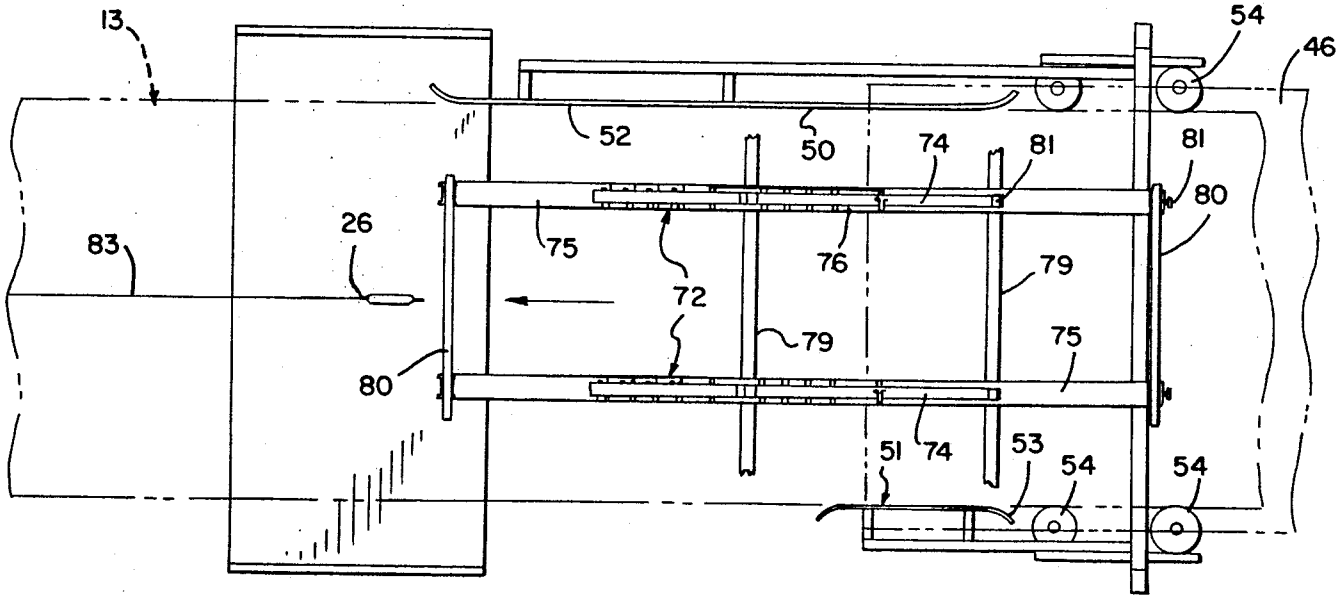
FIG. 8 is a top plan view of the apparatus shown in FIG. 6.
Figure 9:
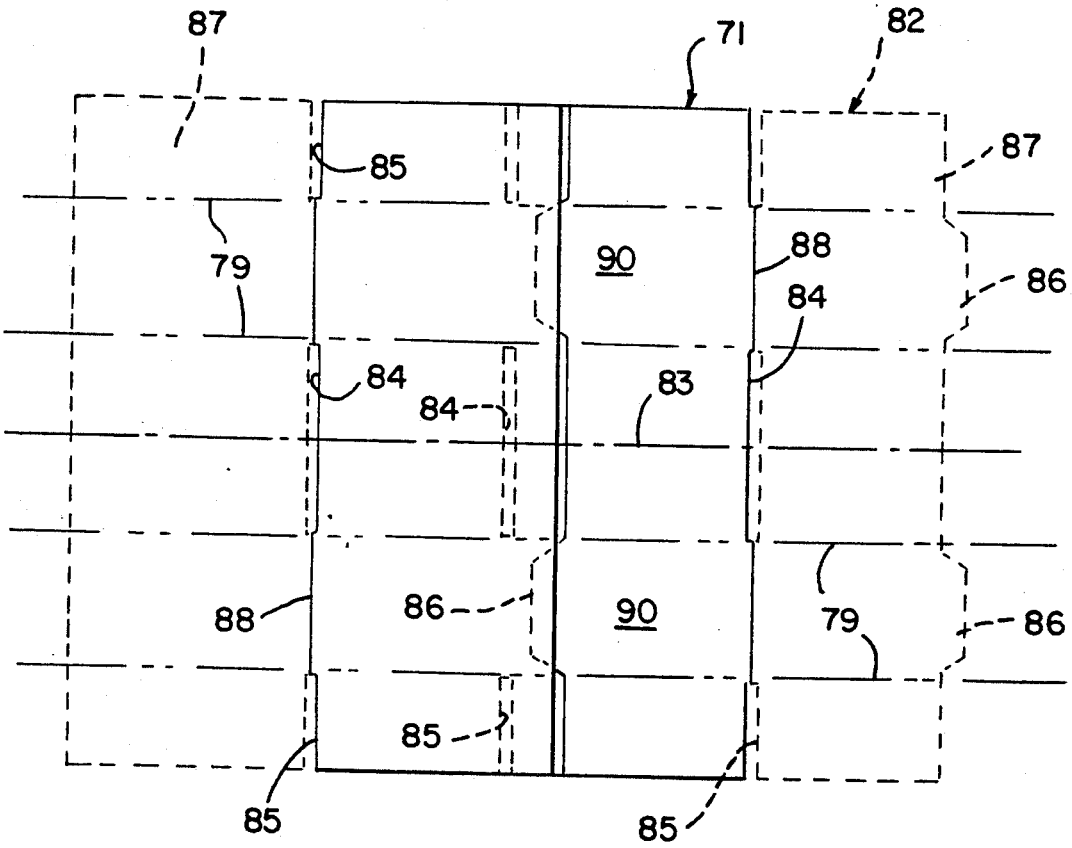
FIG. 9 is a top plan view of a special regular slotted container specially adapted for slitting in accordance with the present invention.

Referring to FIGS. 7-9, an alternate and presently preferred embodiment of the invention is shown, including a special RSC in FIG. 9 which can be slit (after folding and gluing) to make two half-size RSCs. The lower supporting conveyors and the slitting mechanism are identical to those described with respect to the embodiment of FIGS. 1 and 2. The primary difference in the embodiment of corresponding FIGS. 7 and 8 resides in the means utilized to hold the advancing shingle 13 during lateral alignment and subsequent slitting.

It has been found that the upper infeed belt conveyor 45 of the FIGS. 1-2 embodiment tends to inhibit lateral edge alignment of the shingle 13 between the side guides 50 and 51. The shingle 13 of the FIGS. 7-8 embodiment will be described as one composed of partially overlapped knocked down cartons comprising special regular slotted containers 71 of the type shown in FIG. 9. When an attempt is made to register the lateral edges of such containers in a shingle by moving them transversely into the fixed side guide 50 with the movable side guide 51, the downward holding force of the upper infeed conveyors 45 tends to prevent such lateral movement and inhibits proper registration.

An upper holddown apparatus 72 is positioned above the lower infeed belt conveyor 44 and comprises a series of longitudinally spaced and forwardly angled spring fingers 73 depending downwardly from an upper support 74. The lower ends of the spring fingers 73 are commonly attached to a long narrow holddown strip 75 which bears directly against the upper surface of the shingle 13. A pair of identical holddown devices 72 are disposed in spaced parallel relation over the shingle. The upper ends of the spring fingers 73 are pivotally attached to a horizontal support bar 76 by individual pivotal links 77. The support bar 76 is maintained horizontal, but its position may be changed vertically with respect to the upper support 74 by moving the pivotal operating lever 78 and thereby varying the force which the spring fingers 73 exert on the holddown strip 75 and, thus, on the upper surface of the shingle 13. The holddown apparatus 72 is adjusted such that the holddown strips 75 exert a downward force small enough to permit substantially unrestricted transverse shifting of the knocked down boxes 71 forming the shingle 13 under the lateral force imposed by the movable side guide 51.

As is best seen in FIG. 7, there are relatively fewer spring fingers 73 in the area generally above the movable side guide 51 and, therefore, a somewhat lighter holddown force is imposed on the shingle in the area where the boxes are shifted transversely for alignment, whereas the force downstream thereof toward the slitting blade 26 is increased by the use of more closely spaced spring fingers. This permits relatively unrestricted transverse movement of the boxes to provide proper registration, yet allows the shingle to be somewhat more firmly held as it enters the nip between the slitting blade 26 and the lower supporting roller 34.

Each holddown apparatus 72 is mounted for adjustable lateral positioning above the infeed belt conveyor 44. The upper support 74 is slidably attached to a pair of cross beams 79. Similarly, the opposite ends of the holddown strip 75 are slidably mounted on cross bars 80. Suitable manual locking devices 81 are used to secure each holddown apparatus 72 in its selected position.

Referring particularly to FIG. 9, the special regular slotted container (RSC) 71 is formed in a flexo-folder-gluer from a special corrugated paperboard blank 82 which is shown in dashed lines in its flat unfolded condition. As is well known in the art, the blank 82 enters the flexo in a direction transverse to the subsequently formed slit line 83. The blank 82 is similar to that used to form the double RSC 64 shown in FIG. 6. However, blank 82 is formed with a series of parallel center slots 84 each of which is aligned with a pair of conventional edge slots 85 on opposite sides of the blank. The blank includes preformed score lines 79 which will ultimately define the fold lines between the sides of the container and its respective top and bottom closure flaps. The blank also includes a pair of glue tabs 86. The ends 87 of the blank 2 are folded toward each other in the flexo-folder-gluer to form opposite end fold lines 88, each of which coincides with a set of edge slots 85 and a center slot 84. The glue tabs 86 are glued to the overlapping edge of the opposite blank end 87, all in a well known manner. However, when subsequently reoriented 90° and cut along the slit line 83 by the apparatus of the present invention, the glued RSC 71 forms two identical half size RSCs 90.

The small half size RSCs 90 solve many problems typically associated with running small boxes on a conventional flexo. First of all, starting far upstream, small container blanks are difficult to stack because the stack becomes unstable. Narrow stacks frequently tip over and require the use of tie sheets which in turn create problems with automatic feeding devices. Narrow blanks are not easy to convey on conventional material handling systems and are not easily handled on conventional press feeders. Also, flexos must be run more slowly with small sheets because they tend to skew as they are conveyed between the flexographic print cylinders. The double carton blank 82 may be handled by a typical flexo, as well as the upstream handling equipment, without any of the foregoing problems. The flexo printing plates would simply be modified to have two box repeats on each revolution of the print cylinder.

Figure 11:
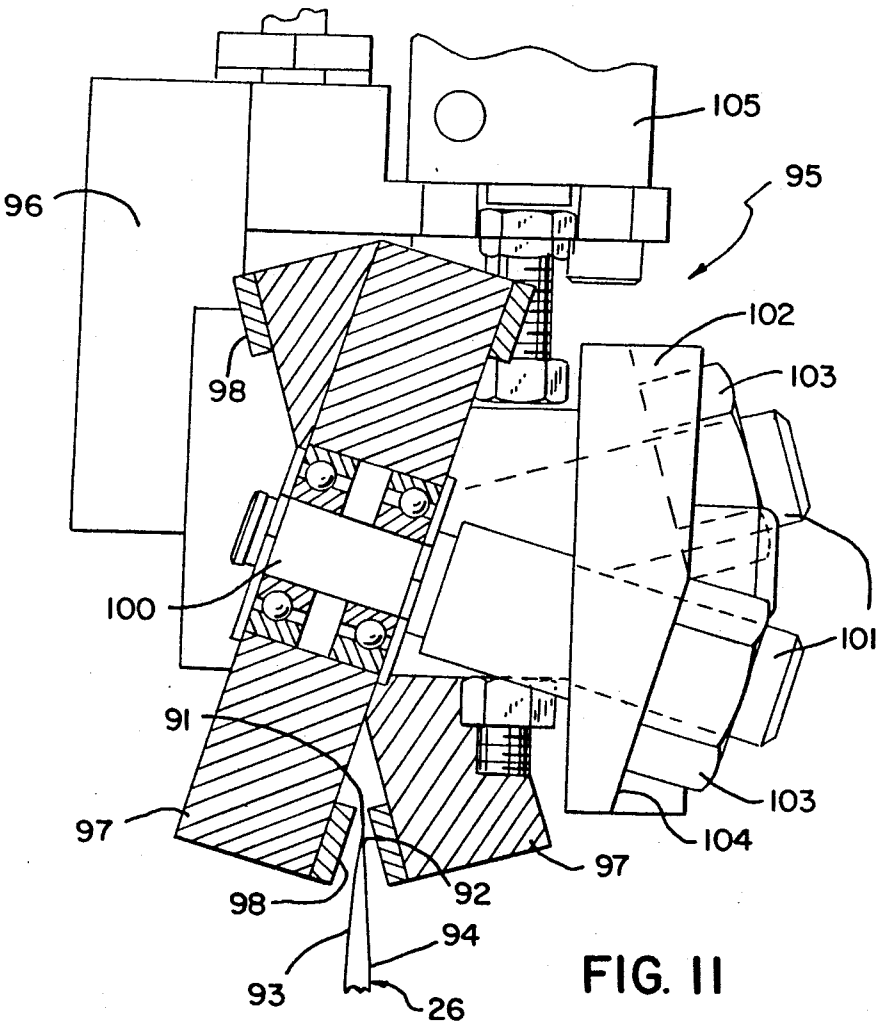
FIG. 11 is an enlarged end view of the apparatus shown in FIG. 9 taken on line 11—11 thereof.
Figure 10:
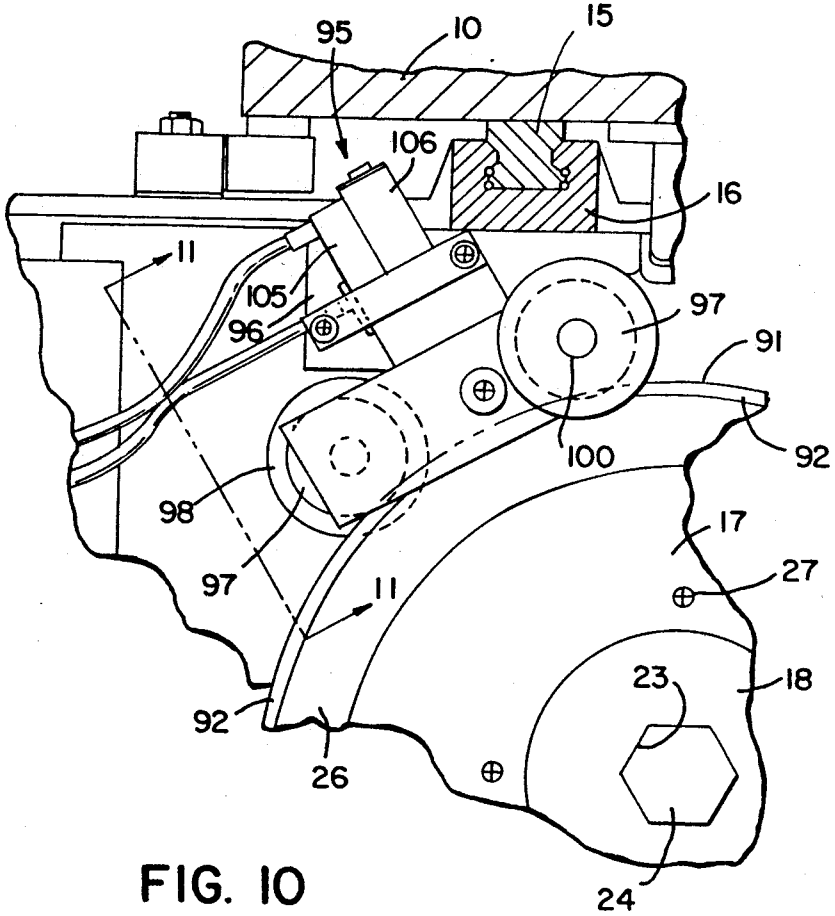
FIG. 10 is an enlarged detail of a portion of FIG. 7 showing a double wheeled blade sharpener.

The highly accurate and precise cut provided by the system of the present invention utilizing the slitting blade 26 requires that the blade be kept in a sharpened condition. As shown in FIGS. 10 and 11, the continuous peripheral cutting edge 91 of the blade is defined by a pair of opposite beveled edge faces 92. The blade preferably also includes intermediate beveled faces 93 which form the transition between the edge faces 92 and the opposite parallel side faces 94 of the blade. Each edge face 92 may be individually sharpened by intermittently moving a grinding wheel into surface contact with the face. However, it is preferable to provide on-the-fly sharpening of the blade faces 92 by using a dual-wheel sharpener 95 of the type shown. The sharpener 95 is attached by a mounting bracket 96 to the main upper frame member 10. A pair of similar grinding wheels 97 are attached to the mounting bracket to straddle the blade edge 91. Each grinding wheel has an annular honing surface 98 and the wheels are mounted such that the planes of the surfaces 98 are parallel to and spaced slightly from the edge faces 92 defining the peripheral cutting edge of the blade. Each of the grinding wheels 97 is rotatably mounted on a shaft 100, the opposite end of which includes a threaded mounting stud 101. Both grinding wheels are attached to a mounting plate 102 with nuts 103 attached to the mounting studs 101 and bearing on respective angled mounting surfaces 104 to dispose the honing surfaces 98 in a position which defines the angle included by the edge faces 92 of the blade. The mounting plate 102 is slidably attached to the mounting bracket 96 and is movable with respect thereto and into contact with the blade edges faces 92 by a pneumatic cylinder 105 operating against the bias of a compression spring 106.

As described in previously identified copending application Ser. No. 490,793, sharpening contact between the honing surfaces 98 and the blade edge faces 92 is maintained for a very short period of time (e.g. a few seconds) and at a very low level of force (e.g. three pounds or less) to remove a small amount of material (e.g. 0.001–0.002 inch) from the blade edge. Also as described in the above identified copending application, the grinding wheels 97 may be independently driven at high speed (e.g. 5,000 rpm) by a small air motor (not shown). Alternately, the grinding wheels 97 may be mounted as simple idler wheels.

As also described hereinabove and in prior copending application Ser. No. 490,793, a blade edge lubricator 43 may be used to prevent the buildup of starch. However, because starch buildup is typically a problem when slitting running corrugated sheet directly out of the corrugator, starch buildup is normally not a problem when slitting folded and glued cartons 71 which are typically formed long after the starch-based glue used in the corrugating process has dried. The glue typically applied to the glue tabs 86 in the gluer is not starch-based, usually dries more quickly, and does not cause a buildup on the blade.

Various modes of carrying out the present invention are contemplated as being within the scope of the following claims particularly pointing out and distinctly claiming the subject matter which is regarded as the invention.

We claim:

1. The method of longitudinally slitting preformed knocked down boxes of folded and glued corrugated paperboard comprising the steps of:

(1) forming a shingle of advancing boxes supported on a conveyor with the folded edges of the boxes extending transversely of the conveyor;

(2) aligning the lateral edges of the advancing shingle by shifting the boxes forming the shingle transversely on said conveyor;

(3) holding the shingle against said conveyor by applying a vertical force to the upper surface of the shingle of a magnitude small enough to permit substantially unrestricted transverse shifting of the boxes in the preceding step;

(4) advancing said shingle into a rotatable annular cutting blade having a smooth continuous peripheral cutting edge defined by opposite beveled edge faces;

(5) rotating the blade in the direction of shingle movement to provide a peripheral blade edge speed at least about two times greater than the speed of the advancing shingle;

(6) supporting the shingle below the cutting blade on an idler roller having an annular circumferential slot positioned to receive therein the peripheral edge of the blade to form a nip; and, (7) sharpening said blade edge faces on-the-fly.

2. The method as set forth in claim 1 wherein the idler roller supporting the shingle has a smooth hard cylindrical outer surface.

3. An apparatus for longitudinally slitting an advancing shingle of preformed knocked down boxes of folded and glued corrugated paperboard blanks, said shingle formed with the folded edges of the boxes oriented transversely of the shingle, said apparatus comprising:

means for conveying the shingle in the direction of formation of the shingle;

means for aligning the lateral edges of the advancing shingle by shifting the boxes forming the shingle transversely on said conveying means into a vertical alignment surface parallel to the direction of movement of the shingle;

means for resiliently holding the shingle against said conveying means by applying a vertical force to the upper surface of the shingle, said force having a magnitude small enough to permit substantially unrestricted transverse shifting of the boxes by said aligning means;

a rotating annular cutting blade disposed in the path of the advancing shingle, said blade having a smooth continuous peripheral cutting edge defined by opposite beveled edge faces;

means for rotating the blade in the direction of shingle movement to provide a peripheral blade edge speed at least about two times greater than the speed of the advancing shingle;

idler roller means for firmly supporting the shingle below the cutting blade, said roller means having an annular circumferential slot positioned to receive therein the peripheral edge of the blade to form a nip; and, means for grinding the edge faces of the cutting blade on-the-fly to sharpen the cutting edge.

4. The method of longitudinally slitting preformed knocked down boxes of folded and glued corrugated paperboard blanks, said method comprising the steps of:

(1) forming a shingle of boxes with the folded edges of the boxes oriented transversely of the shingle;

(2) advancing the shingle on a conveyor in the direction of formation of the shingle;

(3) aligning the lateral edges of the advancing shingle by shifting the boxes forming the shingle transversely on said conveyor into a vertical alignment surface parallel to the direction of movement of the advancing shingle;

(4) holding the shingle against said conveyor by applying a vertical force to the upper surface of the shingle small enough to permit substantially unrestricted transverse shifting of the boxes forming the shingle in the preceding step;

(5) directing the advancing shingle into a rotating annular cutting blade having a smooth continuous peripheral cutting edge defined by beveled edge faces which are similar to each other;

(6) rotating the blade in the direction of shingle movement to provide a peripheral blade edge speed at least about two times greater than the speed of the advancing shingle;

(7) supporting the shingle below the cutting blade on an idler roller having an annular circumferential slot positioned to receive therein the peripheral edge of the blade to form a nip; and (8) grinding the blade edge faces intermittently while the blade is rotating to sharpen the cutting edge.

5. The method as set forth in claim 4 including the modified step of aligning the lateral edges of the advancing shingle before the glue is set.

6. The method as set forth in claim 4 including the step of increasing the vertical holding force applied to the upper surface of the shingle in the direction of the cutting blade.

* * * * *